US010823518B1

(12) United States Patent
Tippmann, Sr. et al.

(10) Patent No.: US 10,823,518 B1
(45) Date of Patent: Nov. 3, 2020

(54) GATLING GUN WITH MAGAZINE FEED MECHANISM

(71) Applicant: TIPPMANN INDUSTRIAL PRODUCTS, INC., Fort Wayne, IN (US)

(72) Inventors: Dennis J. Tippmann, Sr., New Haven, IN (US); Allen Rife, Fort Wayne, IN (US); Kyle Smith, Hudson, IN (US)

(73) Assignee: TIPPMANN INDUSTRIAL PRODUCTS, INC., Fort Wayne, IN (US)

( * ) Notice: Subject to any disclaimer, the term of this patent is extended or adjusted under 35 U.S.C. 154(b) by 0 days.

(21) Appl. No.: 16/740,542

(22) Filed: Jan. 13, 2020

(51) Int. Cl.
*F41A 9/36* (2006.01)
*F41A 9/26* (2006.01)

(52) U.S. Cl.
CPC . *F41A 9/36* (2013.01); *F41A 9/26* (2013.01)

(58) Field of Classification Search
CPC ..... F41A 9/26; F41A 9/36
USPC ..... 89/12
See application file for complete search history.

(56) References Cited

U.S. PATENT DOCUMENTS 3,380,342 A * 4/1968 Chiabrandy ..... F41A 9/36 89/12
3,380,343 A * 4/1968 Chiabrandy ..... F41F 1/10 89/12
3,431,817 A * 3/1969 Walkup ..... F41A 17/14 89/12
3,595,128 A * 7/1971 Hoyt, Jr. ..... F41A 19/30 89/12
3,733,960 A * 5/1973 Ashley ..... F41A 9/35 89/33.03
3,776,416 A * 12/1973 Ashley ..... F41F 1/10 221/21
4,550,641 A * 11/1985 Bruderer ..... F41A 9/36 89/11
5,817,967 A * 10/1998 Simon ..... F41A 9/36 89/12
2009/0314272 A1* 12/2009 Lin ..... F41A 9/74 124/48

OTHER PUBLICATIONS

"Gatling Gun Feeding Mechanisms", https://www.forgottenweapons.com/gatling-gun-feeding-mechanisms/, authored by Ian McCollum and published on Jan. 23, 2013 (Year: 2013).*
The Gatling Gun by Paul Wahl and Donald R. Toppel—ARCO Publishing Company, Inc., 219 Park Avenue South, New York, NY 10003. Copyright Paul Wahl and Donald R. Toppel, 1965.

* cited by examiner

*Primary Examiner* — Samir Abdosh
(74) *Attorney, Agent, or Firm* — Barnes & Thornburg LLP

(57) ABSTRACT

A Gatling gun with a magazine feed mechanism for use with a spring-loaded magazine. The magazine feed mechanism is configured to transfer spring-loaded rounds from the magazine into successive chambers of the plurality of chambers in the Gatling gun. The magazine feed mechanism chambers rounds from the spring-loaded magazine as the gun's bolt carrier rotates during firing.

20 Claims, 19 Drawing Sheets

GATLING GUN WITH MAGAZINE FEED MECHANISM

TECHNICAL FIELD

This disclosure relates generally to Gatling-type guns; in particular, this disclosure relates to a magazine feed mechanism for a Gatling gun.

BACKGROUND

Gatling guns are rapid-fire guns with multiple barrels that rotate around a central axis and are capable of being fired at a rapid rate. Although Gatling guns have become one of the best-known historical rapid-fire guns, the design is mechanically complex and has generally been replaced by modern machine guns. Even though the design is historic, however, it still has some advantages over machine guns. For example, due to the use of multiple barrels, overheating is not as big a problem as conventional machine guns with a single barrel.

Ammunition for Gatling guns are gravity fed. Existing Gatling guns typically have had a hopper that gravity-feeds rounds into the gun's chambers. Other devices, such as drums with an internal rotor, have also been devised for feeding ammunition to Gatling guns; however, these drums are mechanically complex, expensive, and can be fragile.

Unlike the gravity-fed hoppers used with Gatling guns, many modern guns use spring-loaded magazines, which are plentiful and relatively cheap. Typically, when the bolt cycles in modern guns, it strips a round from the magazine and pushes it into the chamber. However, with a Gatling gun, there are difficulties striping rounds from a spring-loaded magazine as the cylinder rotates during firing.

Therefore, a need exists that overcomes one or more of the disadvantages of present devices for feeding Gatling guns with ammunition.

SUMMARY

According to one aspect, this disclosure provides a Gatling gun with a gun body, a bolt carrier, a plurality of barrels, a plurality of bolts, a magazine feed mechanism, and a firing mechanism. The gun body defines an opening configured to receive a magazine. The rotatable bolt carrier defines a plurality of chambers. The plurality of barrels are each longitudinally aligned with a respective chamber of the plurality of chambers. The plurality of bolts are each longitudinally aligned with a respective barrel of the plurality of barrels. The magazine feed mechanism is configured to transfer a spring-loaded round from the magazine into a chamber of the plurality of chambers. The firing mechanism is configured to cause each gun bolt to fire a round in its respective chamber at a particular angular displacement during rotation of the rotatable bolt carrier.

According to another aspect, this disclosure provides a Gatling gun with a gun body defining an opening configured to receive a magazine. The gun includes a rotatable bolt carrier defining a plurality of chambers. There are a plurality of barrels each longitudinally aligned with a respective chamber of the plurality of chambers. The gun has a plurality of bolts each longitudinally aligned with a respective barrel of the plurality of barrels. There is means for successively transferring spring-loaded rounds from the magazine into successive chambers of the plurality of chambers and a firing mechanism configured to cause each bolt to fire a round in its respective chamber at a particular angular displacement during the rotation of the rotatable bolt carrier.

According to a further aspect, this disclosure provides a method of feeding rounds into a Gatling gun. The method includes the steps of providing a gun body defining an opening configured to receive a magazine for feeding spring-loaded rounds into a plurality of chambers defined by a rotatable bolt carrier, wherein a magazine feed mechanism extends from the rotatable bolt carrier and rotates concomitant with the bolt carrier; and rotating the magazine feed mechanism to transfer spring-loaded rounds from the magazine into successive chambers of the plurality of chambers.

BRIEF DESCRIPTION OF THE DRAWINGS

The present disclosure will be described hereafter with reference to the attached drawings which are given as non-limiting examples only, in which.

Figure 1:
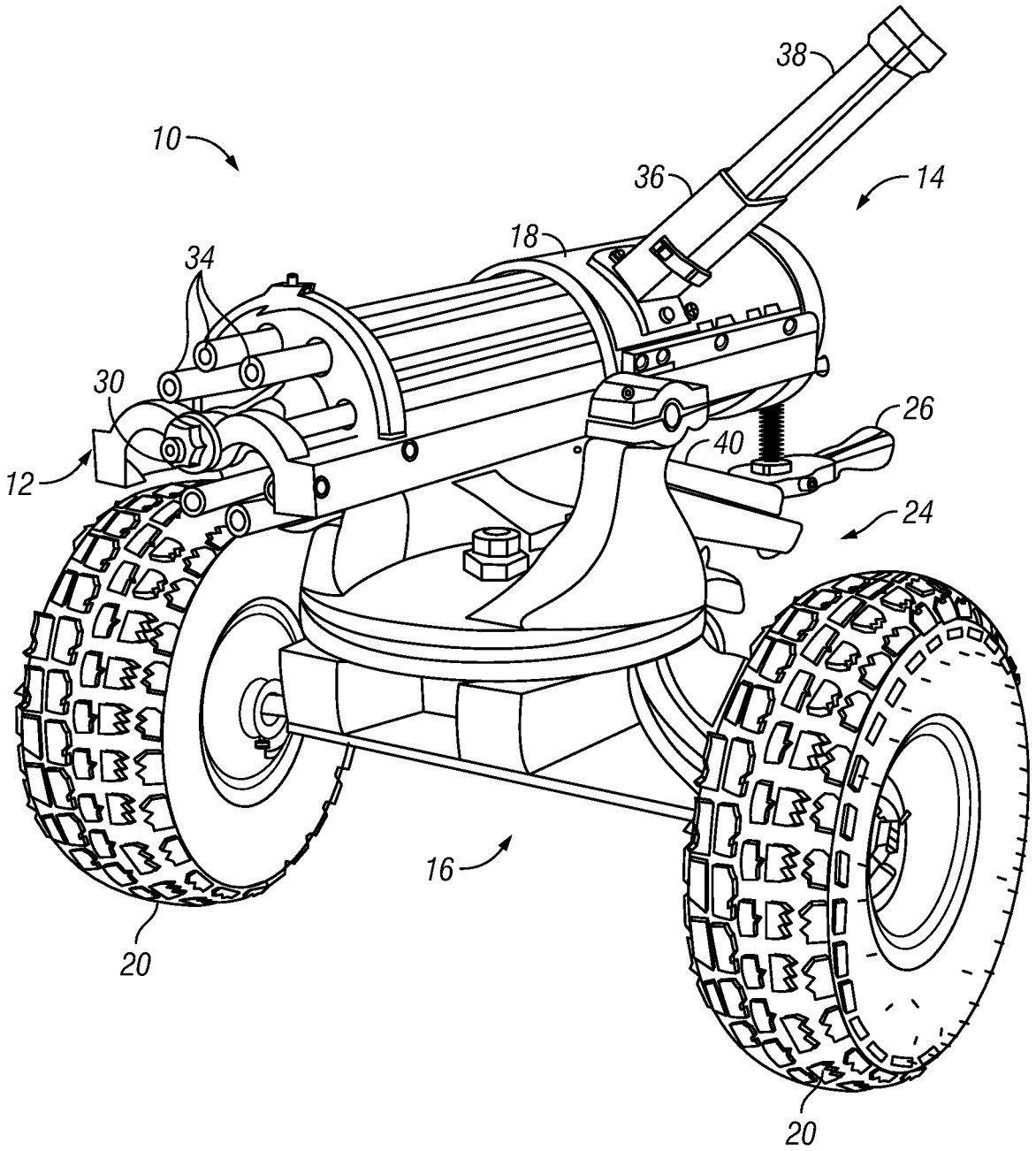
FIG. 1 is front left side perspective view of a Gatling gun according to an embodiment of the present disclosure.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

This disclosure relates to a Gatling gun with a magazine feed mechanism. Unlike existing gravity-fed hoppers, drums and magazines used with Gatling guns, the present magazine feed mechanism is configured to strip rounds from a spring-loaded magazine and deposit each round into the gun's chambers as the cylinder rotates during firing. There are potentially several advantages to using a spring-loaded magazine. For example, spring-loaded magazines are widely available and, therefore, relatively inexpensive. In some embodiments, the Gatling gun and magazine feed mechanism are configured to be compatible with magazines for Glock™ pistols, although spring-loaded magazines for guns of other gun manufacturers are encompassed within this disclosure. By way of example only, in some embodiments, the Gatling gun could be configured to fire 9 mm rounds with a spring-loaded magazine for a Glock™ 17, Glock™ 19 or similar model. Since these magazines are widely available, generally interchangeable, and offer different magazine capacities, this allows the Gatling gun to operate with several different widely available and inexpensive magazines of varying round capacities.

Figure 2:
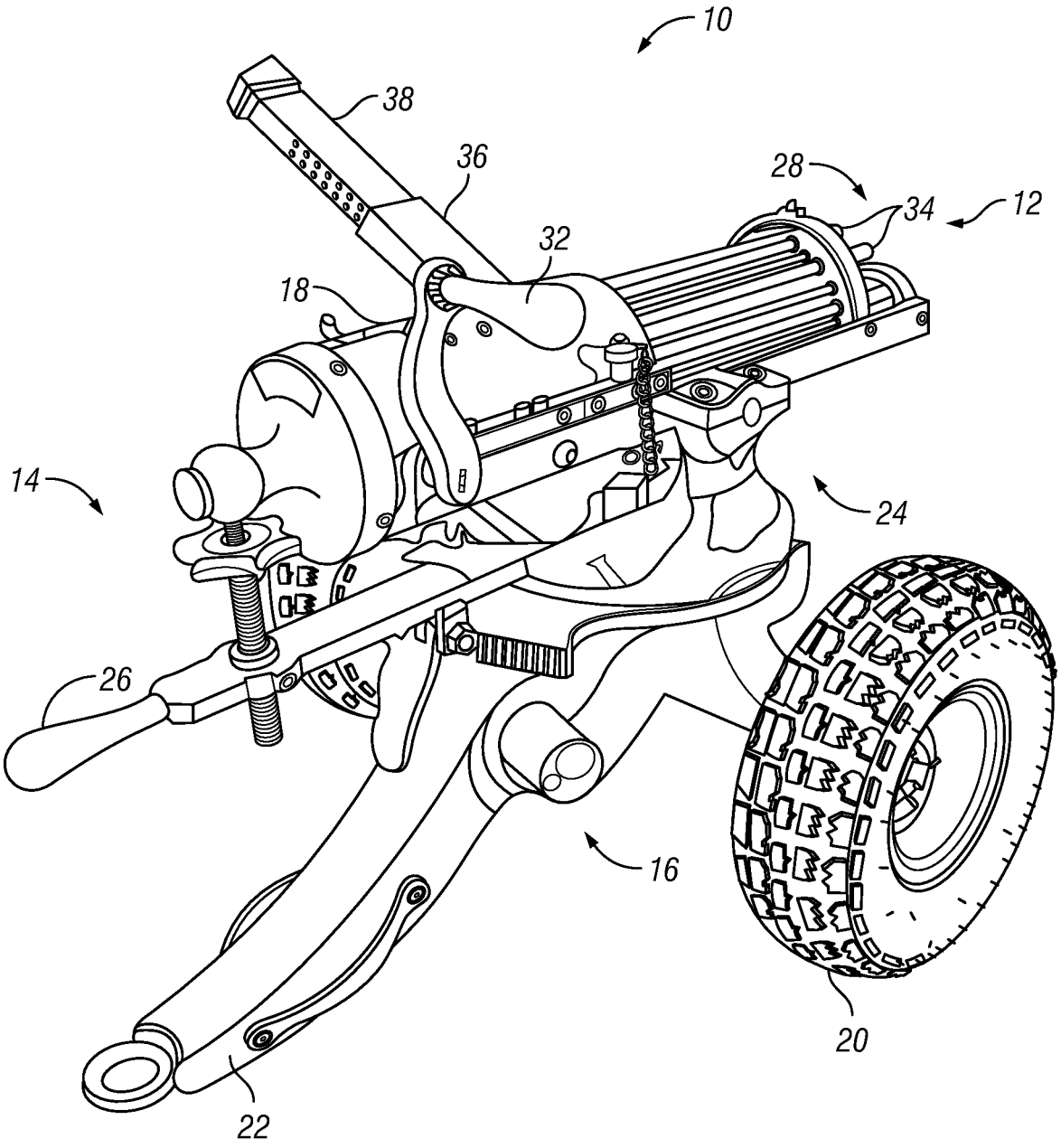
FIG. 2 is rear right side perspective view of the example Gatling gun shown in FIG. 1.

FIGS. 1 and 2 illustrate a Gatling gun assembly 10 according to an embodiment of this disclosure. As shown, the Gatling gun assembly 10 has a front side out which rounds are fired and an opposing back side. In this embodiment, the Gatling gun assembly 10 includes a platform 16 on which a gun body 18 is mounted. As shown, the platform 16 rides on wheels 20 for portability and includes a leg 22 that rests on a surface. With this configuration, the Gatling gun assembly 10 can be moved to a desired location in which the gun body 18 is suspended above the ground. In some configurations, the platform 16 may include a support structure 24 that is movable along multiple axes to aim the gun body 18. For example, the support structure 24 could include a handle 26 that can be used to aim the gun body 18.

As shown, the gun body 18 is formed in a generally cylinder shape and rotates in direction of arrow 28 (clockwise when viewed by back 14) as the Gatling gun assembly 10 is fired. In this embodiment, the gun body 18 rotates about hub 30 by rotating crank 32. As shown, there are a plurality of barrels 34 surrounding the hub 30, and the Gatling gun assembly 10 sequentially fires rounds out of each barrel 34 as a user rotates the crank 32. One skilled in the art should understand that this arrangement is typical of Gatling guns.

In the embodiment shown, the gun body 18 includes an opening through which a magazine well 36 receives a magazine 38 with rounds (also called cartridges) for firing by the Gatling gun assembly 10. The magazine well 36 includes a latch mechanism (not shown) that locks the magazine 38 and magazine well 36 together; the user can actuate the latch mechanism to release the magazine 38. Typically, the magazine 38 is a spring-loaded magazine that can feed a plurality of rounds by urging the rounds into the Gatling gun assembly 10 with a spring (or other biasing member). In some embodiments, the magazine 38 could be a Glock™ compatible magazine, such as a magazine configured for a Glock™ 17 or a Glock™ 19. In some cases, the magazine 38 could be dimensioned for 9 mm cartridges, which are widely available for an inexpensive price, but other calibers are within the scope of this disclosure. After firing, the spent shells exit the Gatling gun assembly 10 through an ejection port onto an ejection guide 40.

Figure 3:
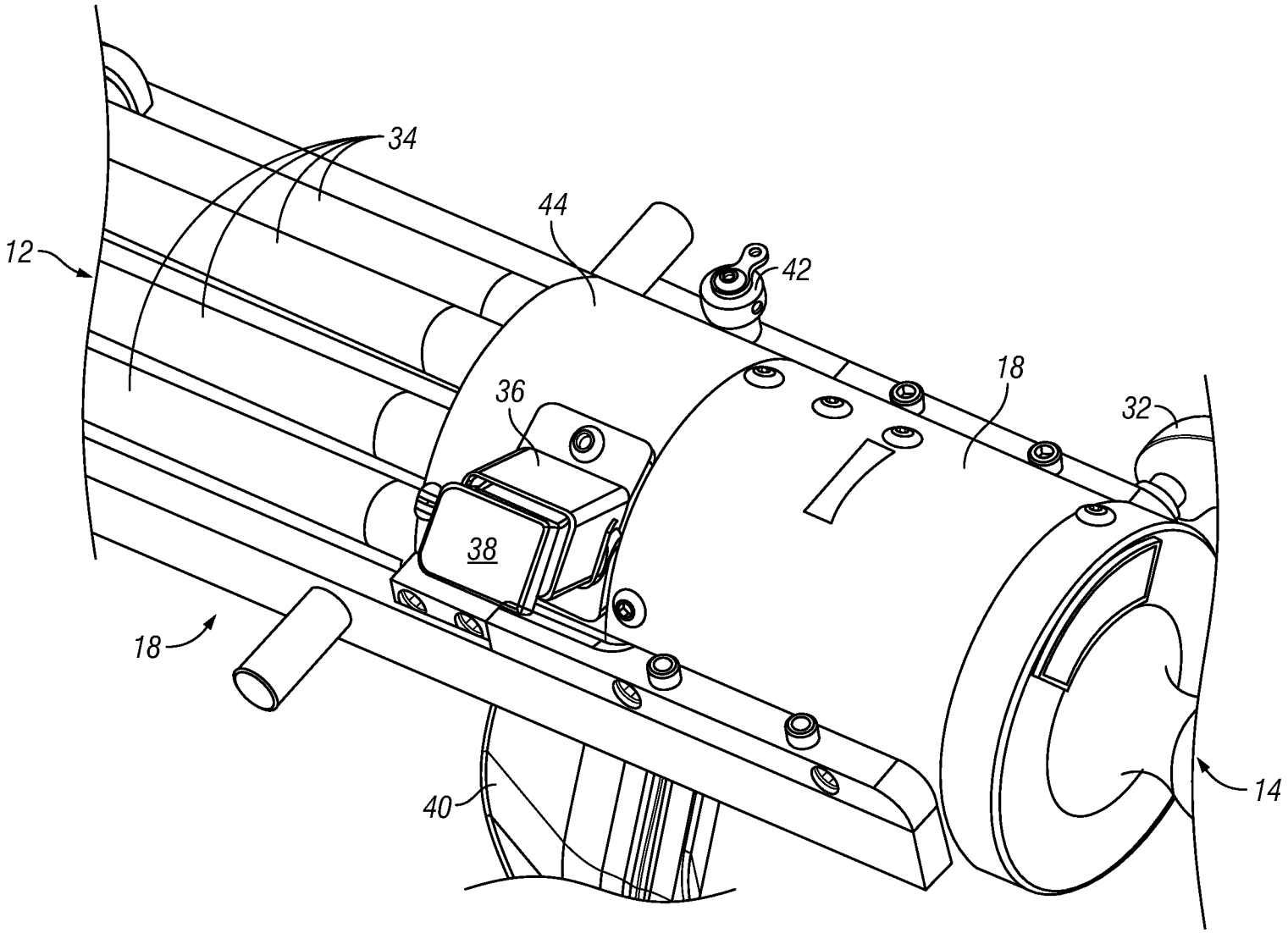
FIG. 3 is a partial rear perspective view of the cylinder from the Gatling gun shown in FIG. 1.
Figure 4:
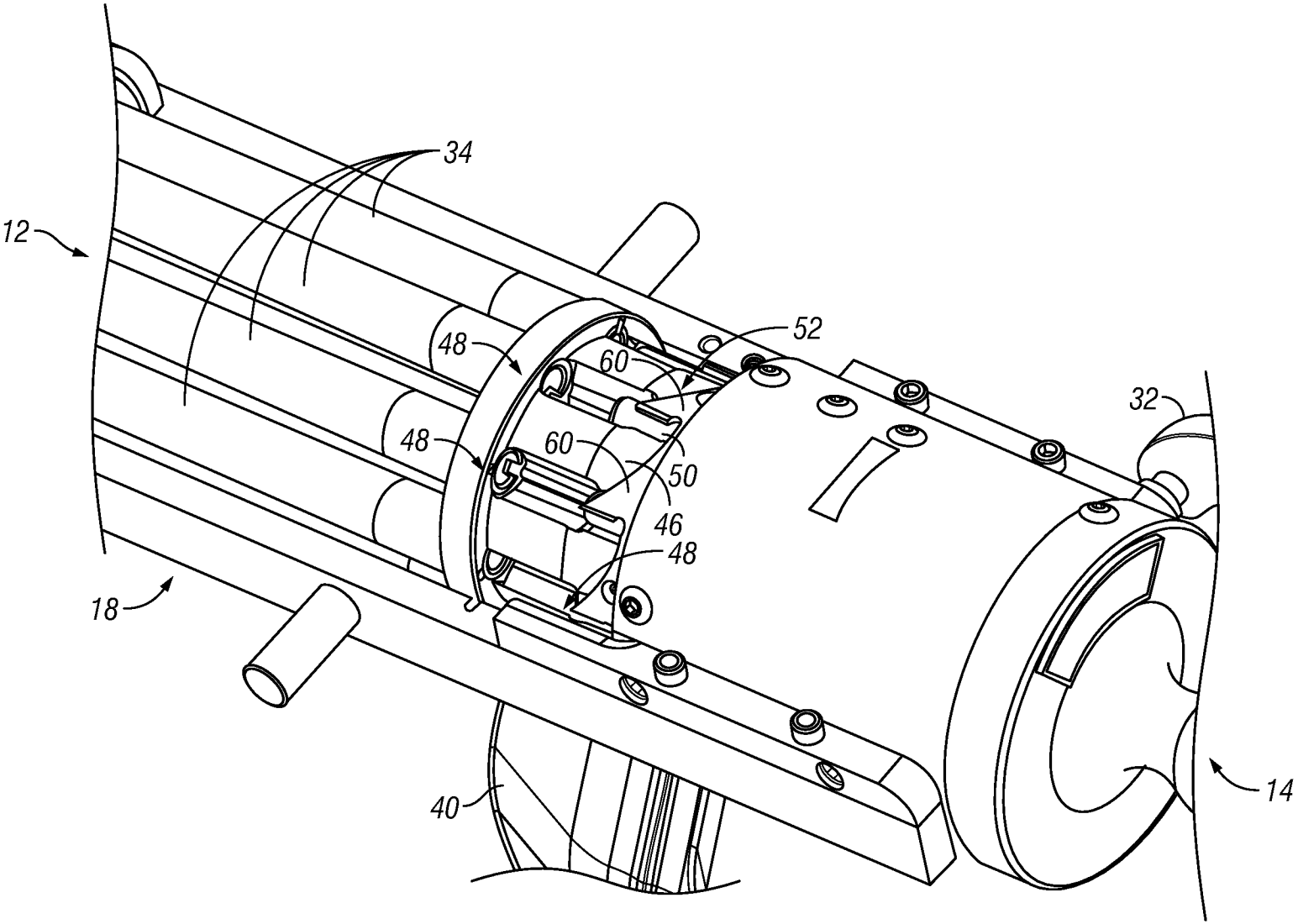
FIG. 4 is a perspective view of the cylinder shown in FIG. 3 with a portion of the body removed to reveal internal components of the magazine feed mechanism and chamber according to an embodiment of the present disclosure.

FIGS. 3 and 4 are partial views of the Gatling gun assembly 10 showing the position of the magazine 38 with regard to the gun body 18. As shown, there is a release mechanism 42 that selectively connects a cover 44 for a bolt carrier 46 with regard to the gun body 18, which is a portion of the gun body 18 that covers a portion of the bolt carrier 44. FIG. 3 shows the cover 44 connected with the gun body 18 and FIG. 4 shows the cover 44 removed to reveal the bolt carrier 46.

As seen in FIG. 4, the bolt carrier 44 includes a plurality of chambers 48. A plurality of bolts 50 corresponding to each of the plurality of chambers 46 are movable to, among other things, push chambered rounds into respective barrels 34 for firing and include extractor to aid in extracting a spent chamber out the Gatling gun assembly 10. The bolt carrier 46 rotates in response to rotating the crank 32 to fire rounds.

In the embodiment shown, a magazine feed mechanism 52 surrounds the bolt carrier 46 and rotates concomitant with the bolt carrier 46. In this manner, both the magazine feed mechanism 52 and the bolt carrier 46 rotate about a common axis. As discussed herein, the magazine feed mechanism 52 moves with respect to the magazine 38 and is configured to strip a leading cartridge from the magazine 38 and chamber that cartridge into one of the chambers 48.

Figure 14:
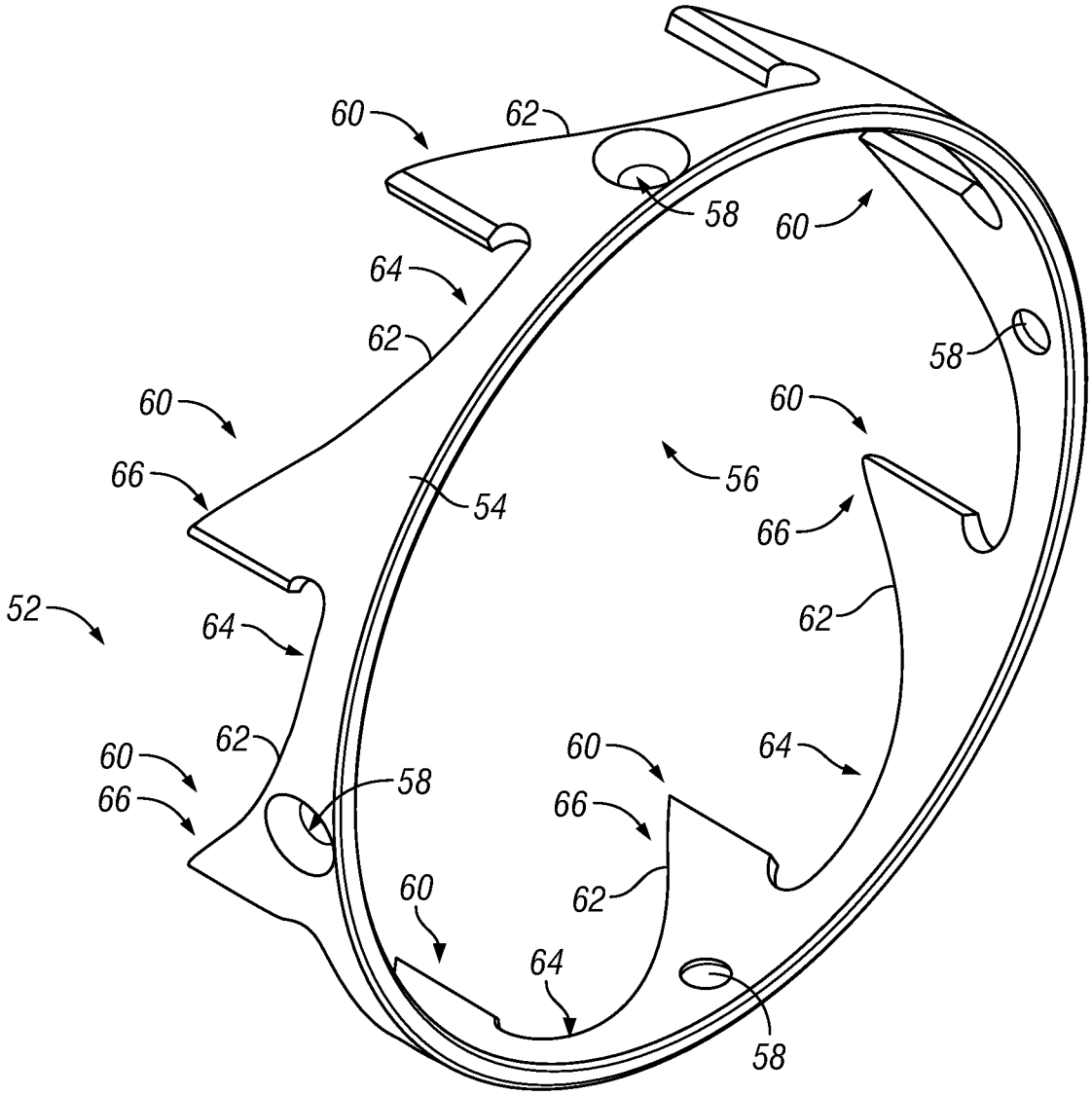
FIG. 14 is a perspective view showing an example magazine feed mechanism according to an embodiment of the present disclosure.

In the embodiment shown, and now also referring to FIG. 14, the magazine feed mechanism 52 includes a ring portion 54 that surrounds the bolt carrier 46. As shown, the ring portion 54 is approximately circular in shape with a central opening 56 dimensioned to receive the bolt carrier 46. As shown, the ring portion 54 defines a plurality of radial-extending holes 58 dimensioned to receive fasteners, such as screws. For example, these holes 58 could correspond with threaded holes in the bolt carrier 46 to attach the magazine feed mechanism 52 to the bolt carrier 46. Of course the ring portion 54 could be attached with the bolt carrier 46 with other types of fasteners, welding and/or adhesive.

In the embodiment shown, the magazine feed mechanism 52 includes a plurality of feed portions 60 spaced equidistant around the circumference of the ring portion 54. The spacing of the feed portions 60 correspond with the chambers 48 in the bolt carrier 46. In other words, there is a feed portion 60 for each chamber 48; as shown, there are eight feed portions 60 corresponding to eight chambers 48; these eight feed portions 60 are spaced apart corresponding to the spacing of the eight chambers 48. As shown, the feed portions 60 each include a curved edge 62 that is configured to engage with a leading round from the magazine 38. The curved edge 62 acts as a cam to strip the leading round from the magazine and move the round into the next chamber 48 as the bolt carrier 46 rotates.

The curvature of the curved edge 62 is configured such that a starting portion 64 of each curved edge 62 is aligned to engage a leading round from the magazine 38 and a terminating portion 66 corresponds with the position of the next chamber 48. As the bolt carrier 46 rotates, the curved edge 62 moves the round along a longitudinal axis of the chamber 48 into the next chamber 48. Thus, in the embodiment shown, the curved edge 62 cams the leading round along a longitudinal axis of the chamber 48 as the bolt carrier 46 rotates. One potential technical advantage, in some embodiments, is that the bolt design can be simplified because the bolt 50 does not need to strip the round from the magazine 38, but the magazine feed mechanism 52 strips the round and moves that round into the next chamber 48 as the bolt carrier 46 rotates.

Figure 5:
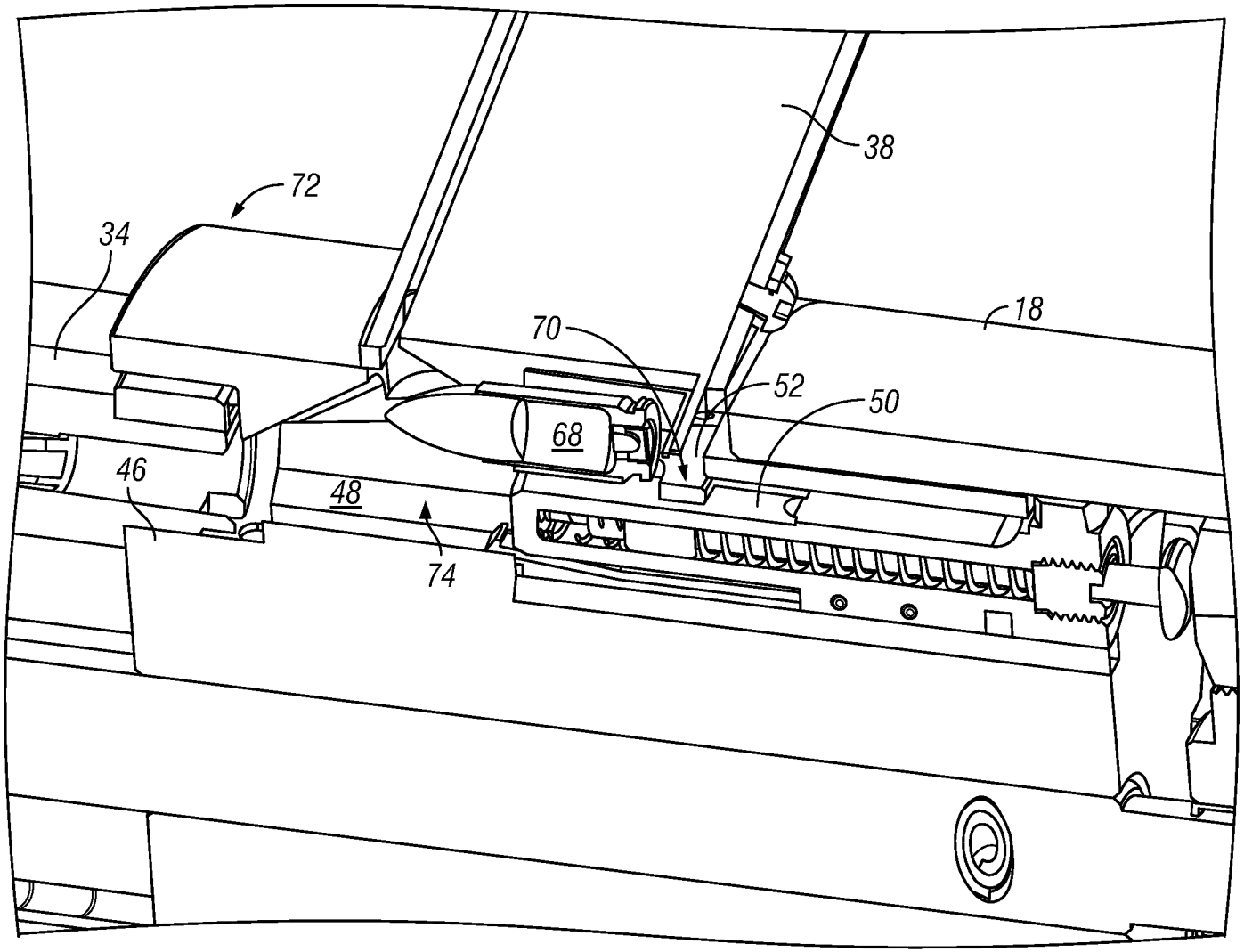
FIG. 5 is a side cross-sectional view along line 5-5 of FIG. 6.
Figure 6:
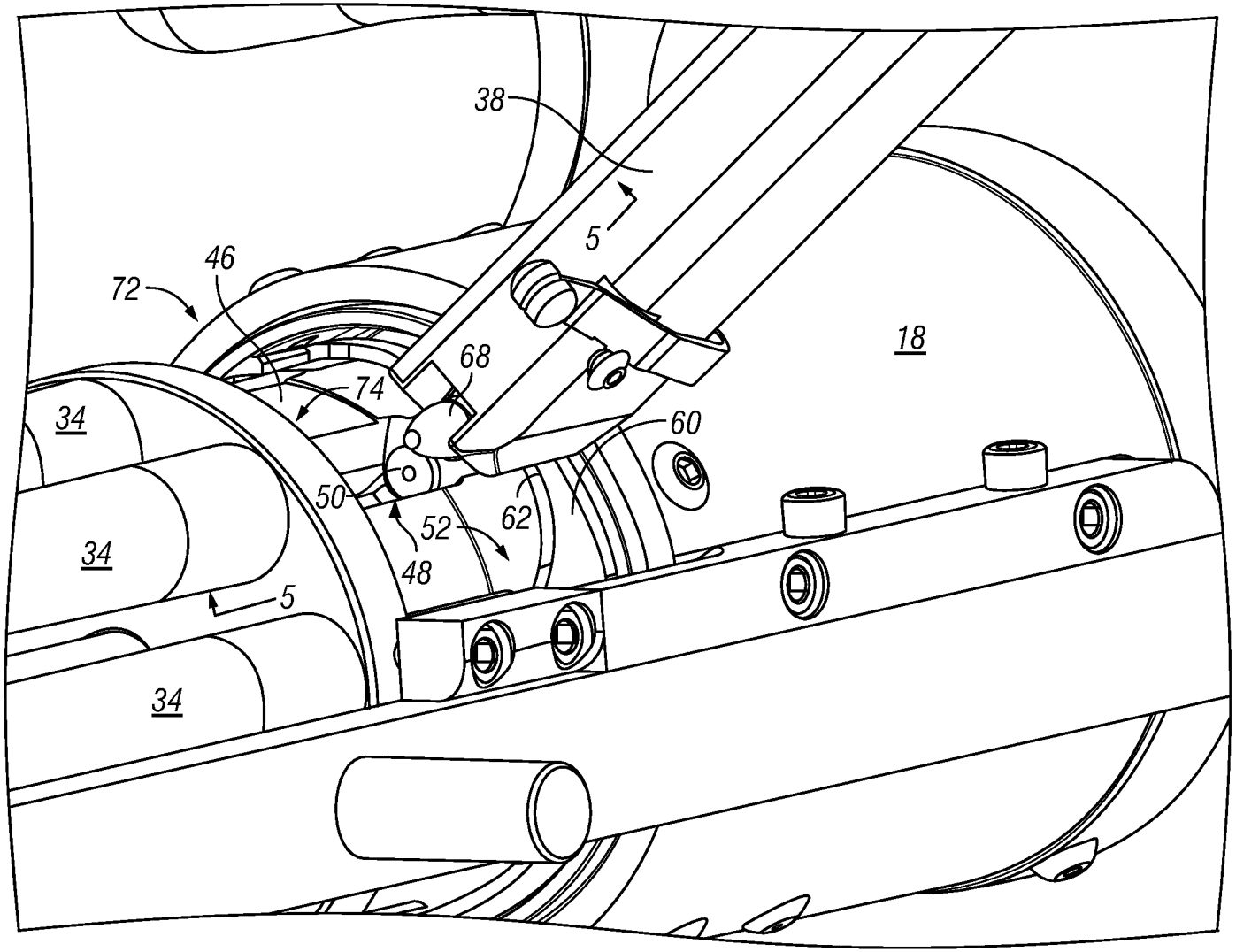
FIG. 6 is a partial left side perspective view showing a magazine in relation to a chamber of the Gatling gun shown in FIG. 1.

Referring now to FIGS. 5 and 6, there is shown an embodiment of the magazine feed mechanism 52 installed on a bolt carrier 46. The feed portions 60 of the magazine feed mechanism 52 are arranged proximate to a leading round 68 in the magazine 38 such that the feed portions 60 (near the starting portion 64) engages the leading round 68 to strip the round 68 from the magazine 38. As shown, the curved edge 62 of the feed portion 60 is arranged proximate a rear side 70 of the leading round 68. As the bolt carrier 46 rotates in direction of arrow 72, the curved edge 62 engages the rear side 70 of the leading round 68. As the bolt carrier 46 rotates, the curved edge 62 cams the leading round 68 in direction of arrow 74 (moving the leading round 68 in direction of chamber's 48 longitudinal axis, which is the axis show by arrow 74). The curvature of the curved edge 62 is configured to move the leading round 68 in direction of arrow 74 such that the round 68 is moved forward sufficiently to clear the rear side 70 to be deposited into the chamber 48 when the leading round 68 reaches the terminating portion 66 of the curved edge 62. The bolt 50 then pushes the distal end of the round into the barrel 34 for firing. As each of the feed portions 60 rotate with the bolt carrier 46, each of the feed portions 60 strips a round from the magazine in secession, and deposits that round into a corresponding chamber for firing.

Figure 7:
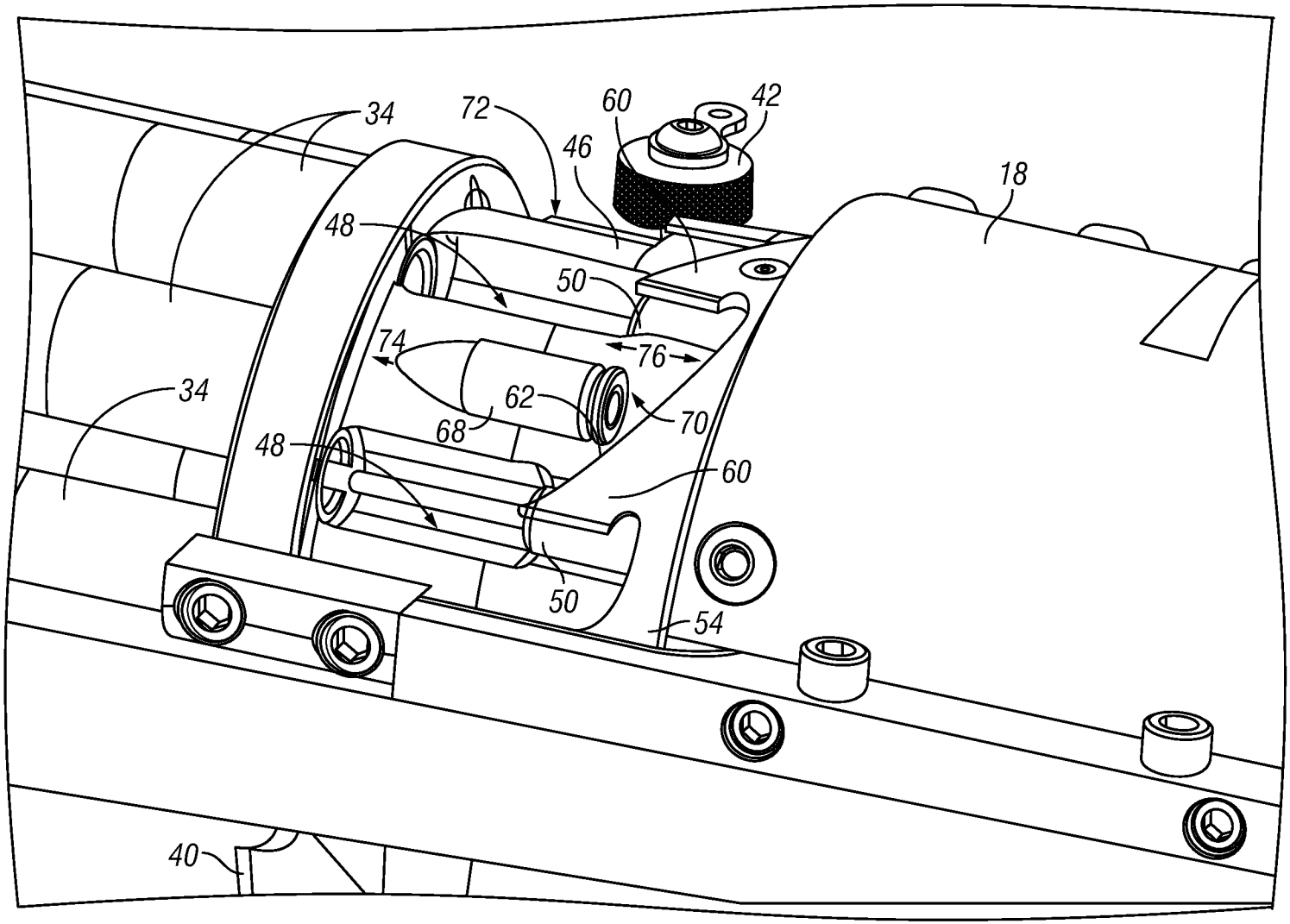
FIGS. 7-9 is a series of progressive perspective views with components removed to reveal the magazine feed mechanism depositing a cartridge into the chamber.
Figure 8:
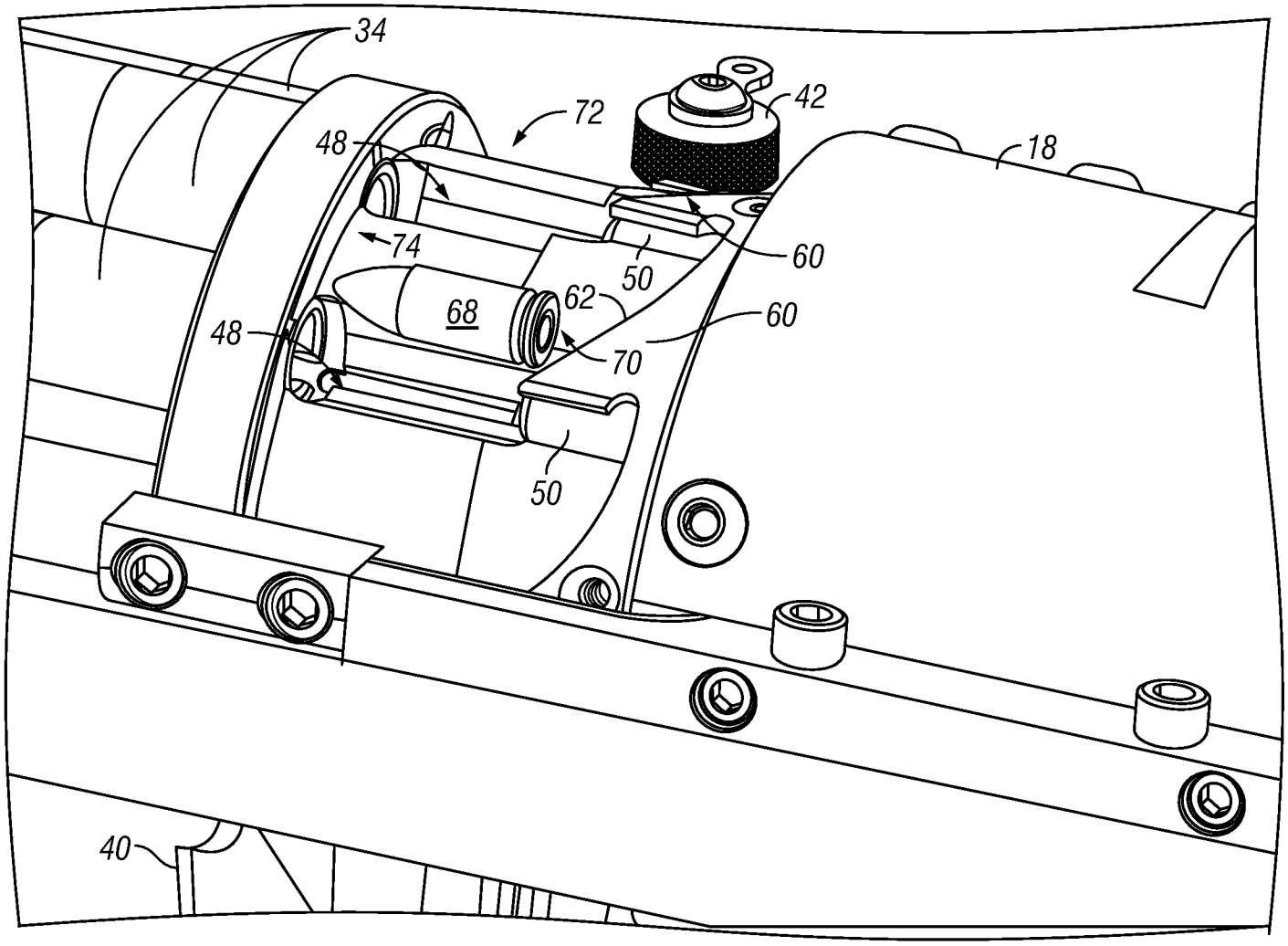
Figure 9:
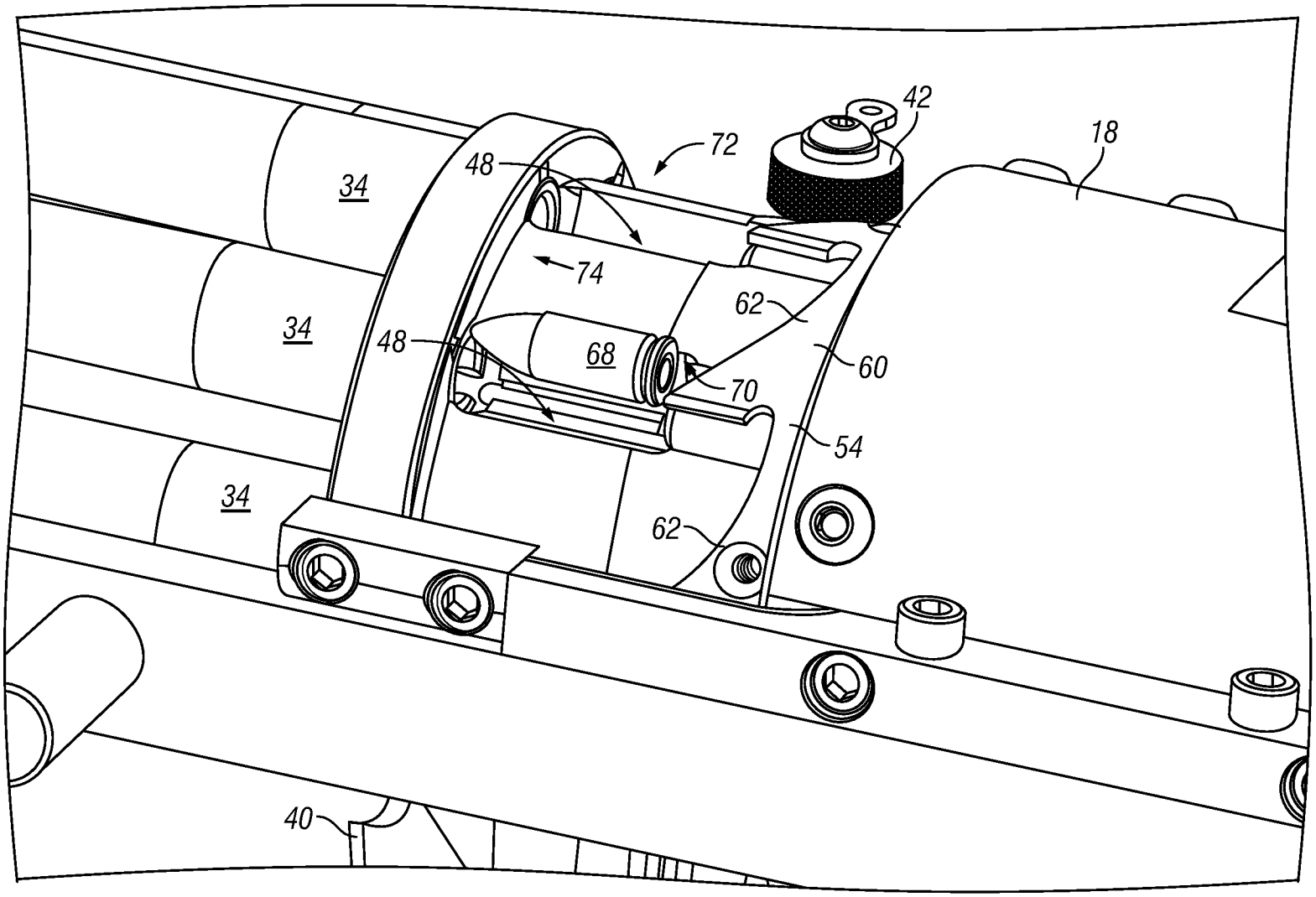
Figure 10:
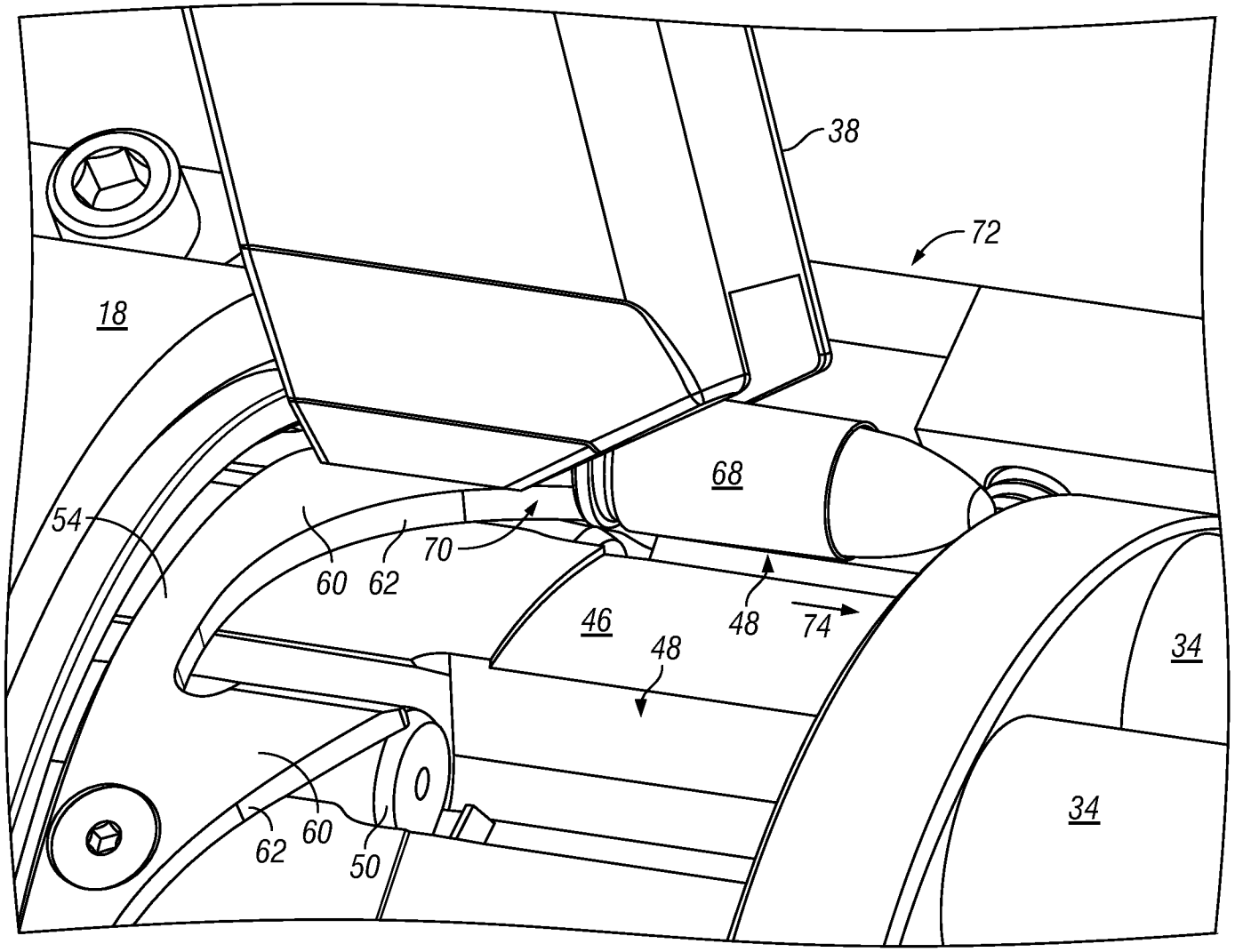
FIG. 10 is a perspective view with components removed to show the magazine feed mechanism stripping a cartridge from the magazine according to an embodiment of the present disclosure.
Figure 11:
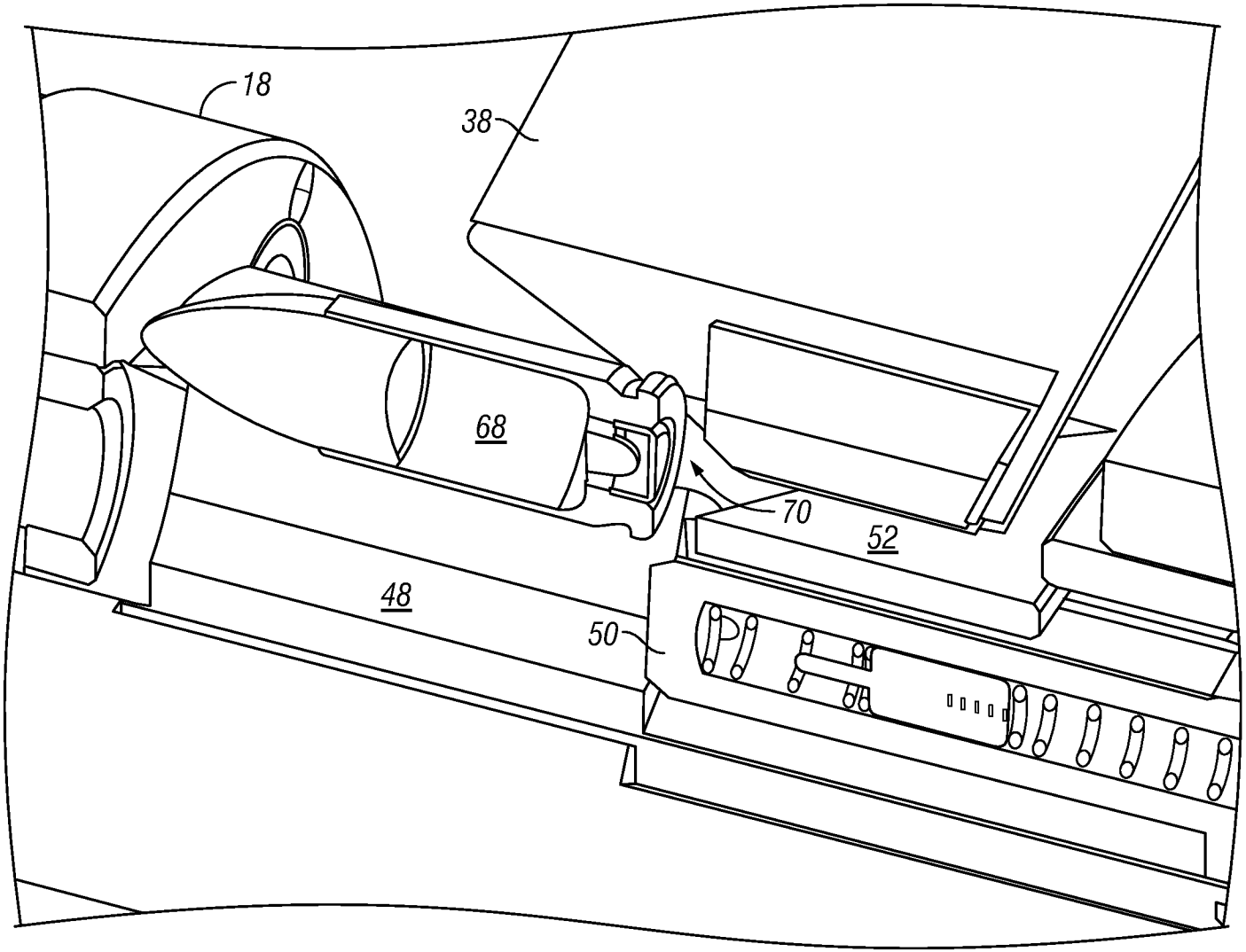
FIG. 11 is a side cross-sectional view showing a cartridge being stripped from the magazine and being deposited into the chamber.
Figure 12:
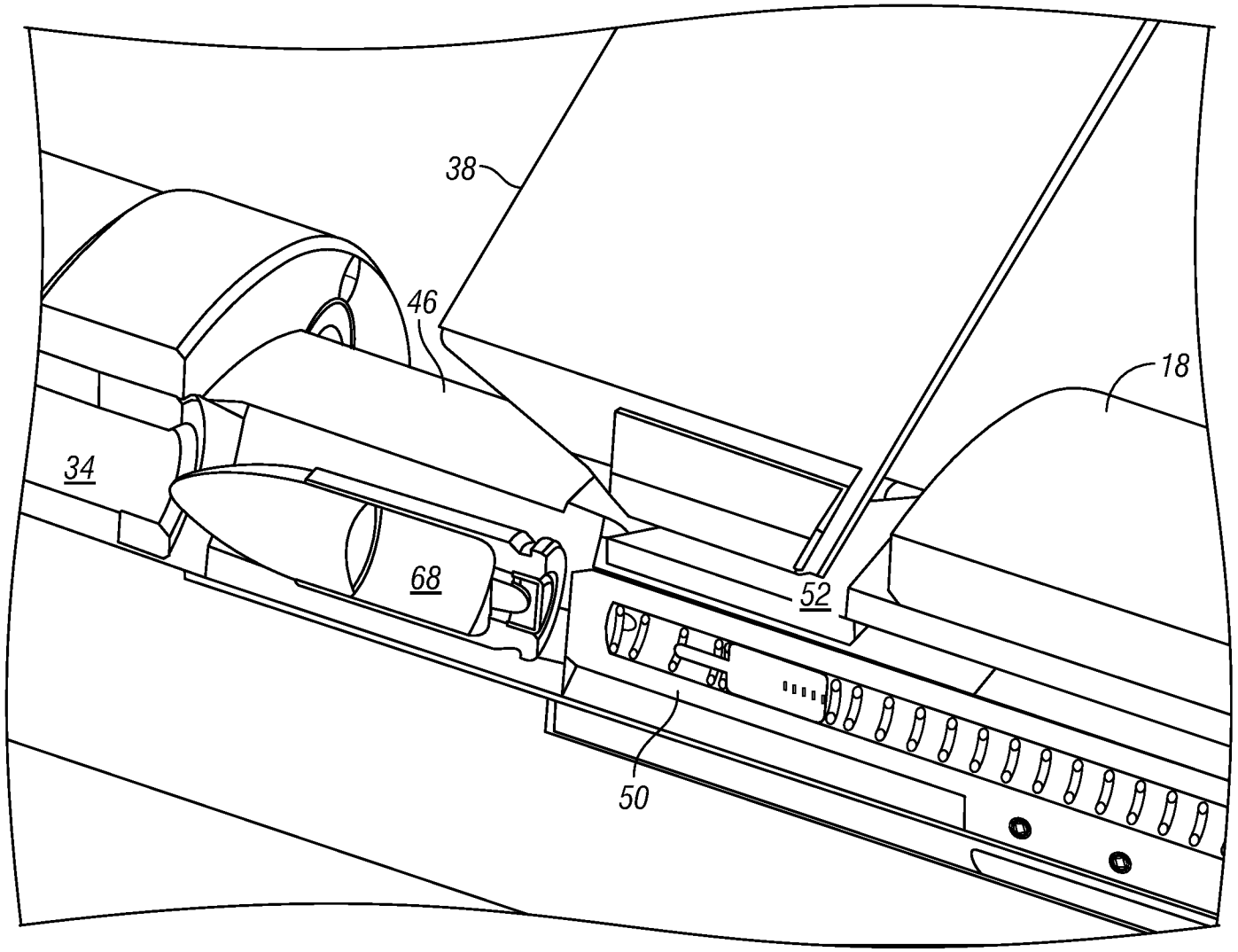
FIG. 12 is a side cross-sectional view showing the cartridge deposited into the chamber by the magazine feed mechanism according to an embodiment of the present disclosure.
Figure 13:
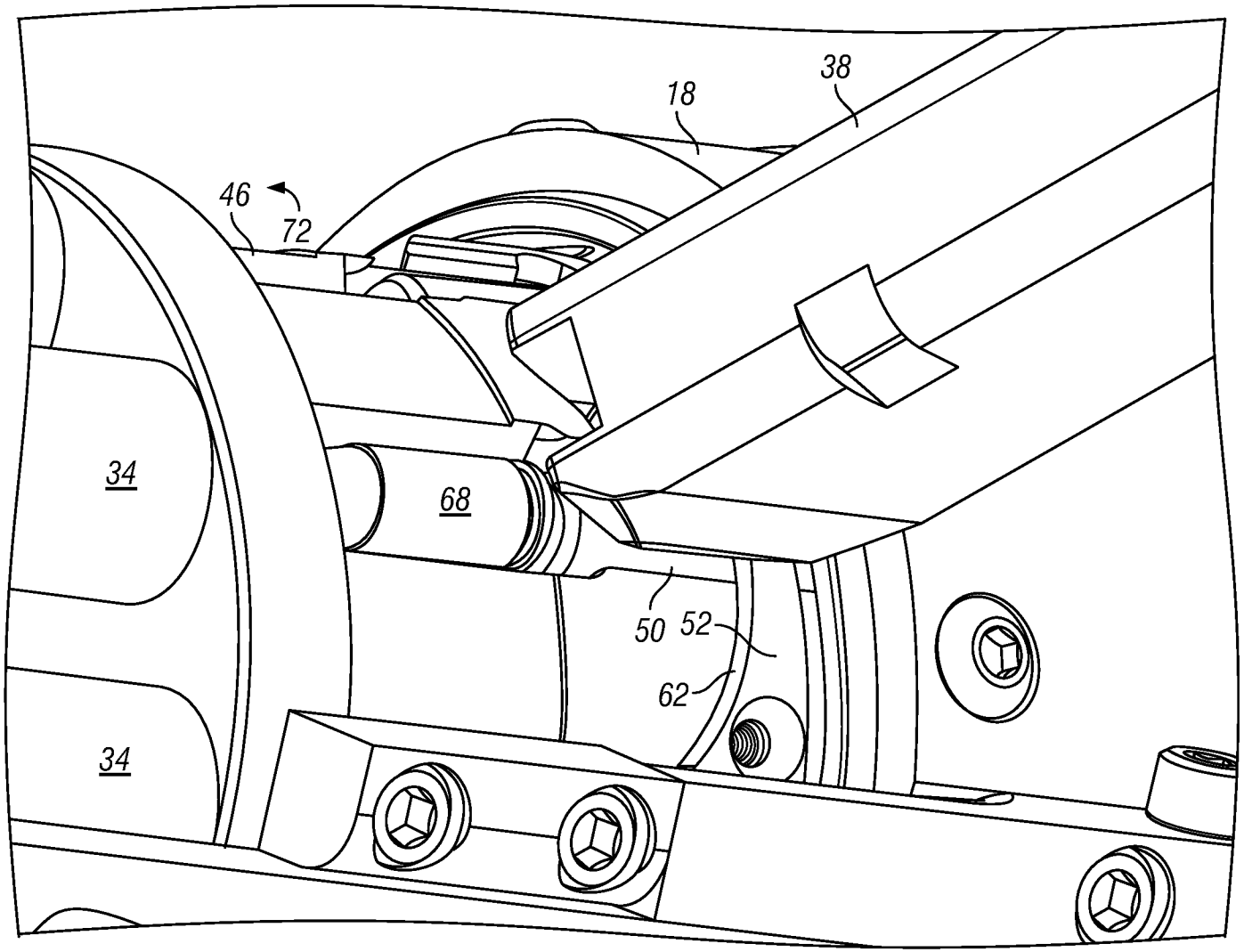
FIG. 13 is a side perspective view with components removed to show the cartridge in the chamber.

FIGS. 7-9 show progressive views in which the rear 70 of round 68 cams on the curved edge 62 of the feed portion 60, which strips round 68 from magazine 38 as the curved edge 62 moves the round 68 in direction of arrow 74 as the bolt carrier 46 rotates in direction of arrow 72 and then continues to move the round 68 forward in direction of arrow 74 to be deposited in chamber 48. As seen, the leading round 68 of the magazine 38 (see FIG. 6) is positioned offset from the chambers 48 along the axis of arrow 74. For the round 68 to be chambered, the round 68 must travel forward in direction of arrow 74 a distance 76 for the round 68 to be axially aligned along arrow 74 (i.e., rear 70 of round 68 must be moved forward to clear chamber 48) with the chamber 48 and be deposited into the chamber 48 by the time the round 68 reaches the chamber 48 as the bolt carrier 46 rotates in direction of arrow 72. Thus, the round 68 moves opposite direction of arrow 72 due to rotation of the bolt carrier 46 while also moving forward in direction of arrow 74 due to curved edge 62 until the round 68 is deposited into the chamber 48. This process happens in secession to strip the magazine 38 of a round and deposit that round in the next chamber, and so forth to continually deposit a round in each chamber as the bolt carrier 46 rotates.

In the example shown in FIG. 7, the round 68 is shown prior to the bolt carrier 46 rotating sufficiently in direction of arrow 72 for the round 68 to reach the next chamber 48. The rear 70 of the round 68 is camming on the curved edge 62, which moves the round 68 forwardly in direction of arrow 74. FIG. 8 shows the round 68 after the bolt carrier 46 has rotated in direction of arrow 72 from FIG. 7. As can be seen in FIG. 8, the round 68 has moved opposite to direction of arrow 72 due to rotation of bolt carrier 46; additionally, the round 68 has moved forward in direction of arrow 74 along curved edge 62. In the position shown in FIG. 8, the round 68 has moved closer to chamber 48, and then in FIG. 9, the round 68 has moved over the chamber 48, and the curved edge 62 has moved the rear 70 of the round 68 sufficiently forward in direction of arrow 74 to clear the rear of chamber 48, and be deposited into the chamber 48.

FIGS. 10-13 are various views of the magazine 38 as the leading round 68 is chambered into the next chamber 48. As discussed above, the round 68 rides on cam surface (curved edge) 62 as the bolt carrier 46 rotates in direction of arrow 72. As the round 68 cams on the curved edge 62, the curvature moves the round 68 in direction of arrow 74 until the round 68 is chambered in the next chamber 48.

Figure 15:
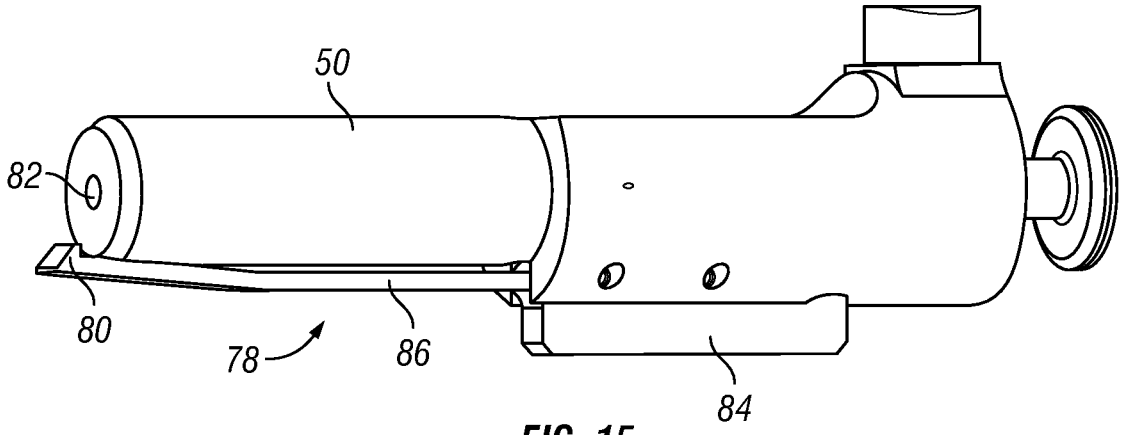
FIG. 15 is a perspective view of an example bolt with an extractor according to an embodiment of the present disclosure.

FIG. 15 shows an example bolt 50 with an extractor 78 with a claw 80 that is configured to engage the rim of the round 68. As is typical of gun bolts, the bolt 50 is configured to move between a retracted position in which the bolt 50 is clear of the chamber 48 so the round 68 can be chambered and an extended position in which the bolt 50 pushes the chambered round 68 into the corresponding barrel 34 and the firing pin (not shown) extends through a firing pin opening 82 to fire the round 68. After firing, the bolt 50 moves backwards toward its retracted position. Due to the engagement of the claw 80 of the extractor 78 with the rim of the round 68, this backwards motion pulls the casing of the round 68 out of the barrel 34 so the round can exit the chamber 48. As shown, the extractor 78 includes a base portion 84 connected with the bolt 50 and an arm 86 that extends to the claw 80. In the embodiment shown, the extractor 78 is positioned on the bottom of the bolt 50 opposite the position of the magazine 38; in other words, in some embodiments the extractor 78 is angularly approximately 180 degrees from the position of the magazine 38.

Figure 16:
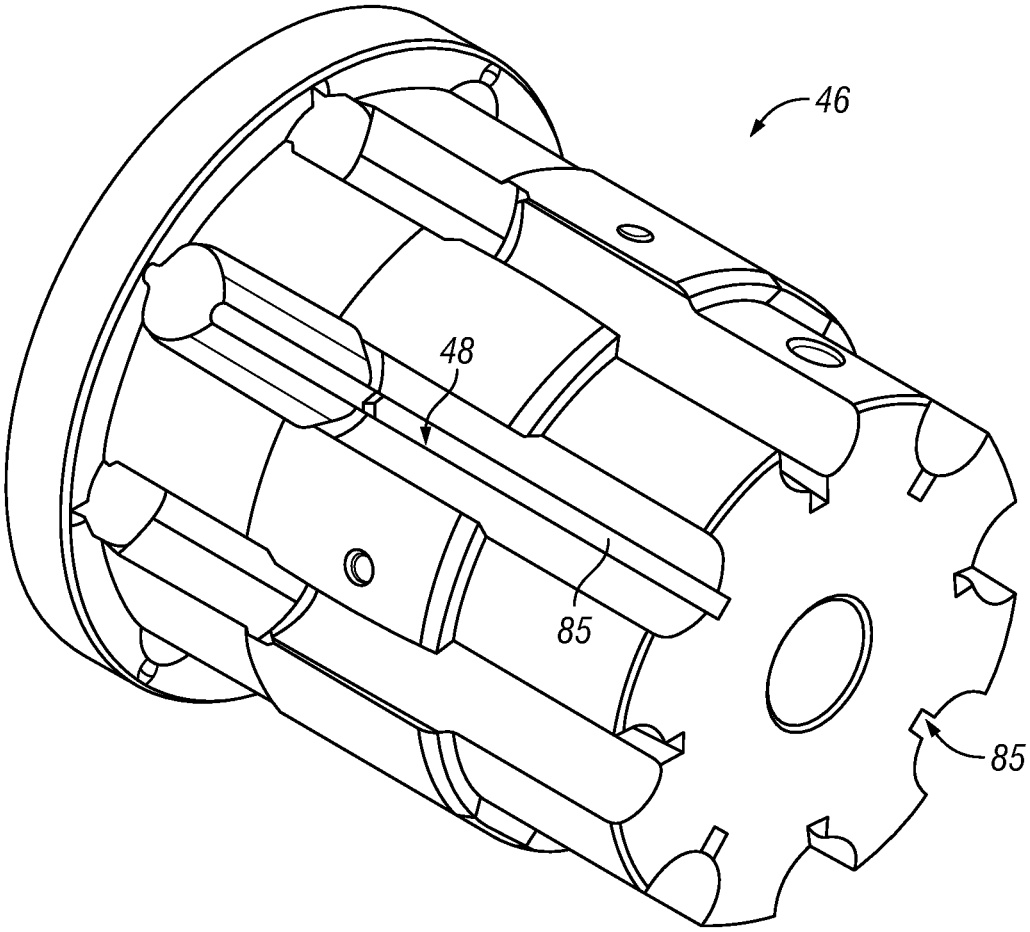
FIG. 16 is a perspective view of an example bolt carrier according to an embodiment of the present disclosure.
Figure 17:
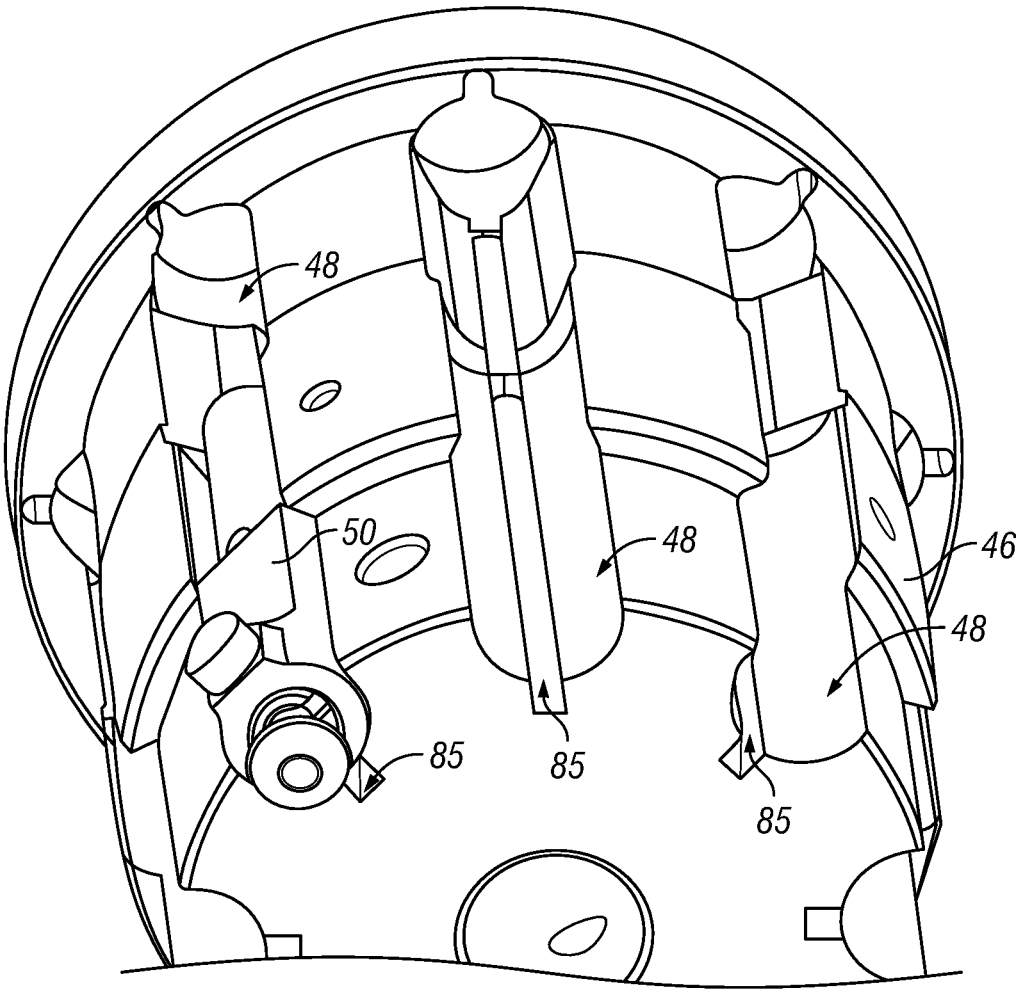
FIG. 17 is a perspective view of an example bolt within the bolt carrier according to an embodiment of the present disclosure.

FIG. 16 shows an example bolt carrier 46 with a plurality of chambers 48. As shown, each chamber 48 includes a longitudinally-extending slot 85 dimensioned to receive the base portion 84 of the extractor 78. The slot 84 extends along the chamber 48, which guides movement of the bolt 50 between its retracted and extended positions. FIG. 17 shows a view of the bolt carrier 46 to show the slot 85 along which the base portion 84 of the extractor 78 rides.

Figure 18:
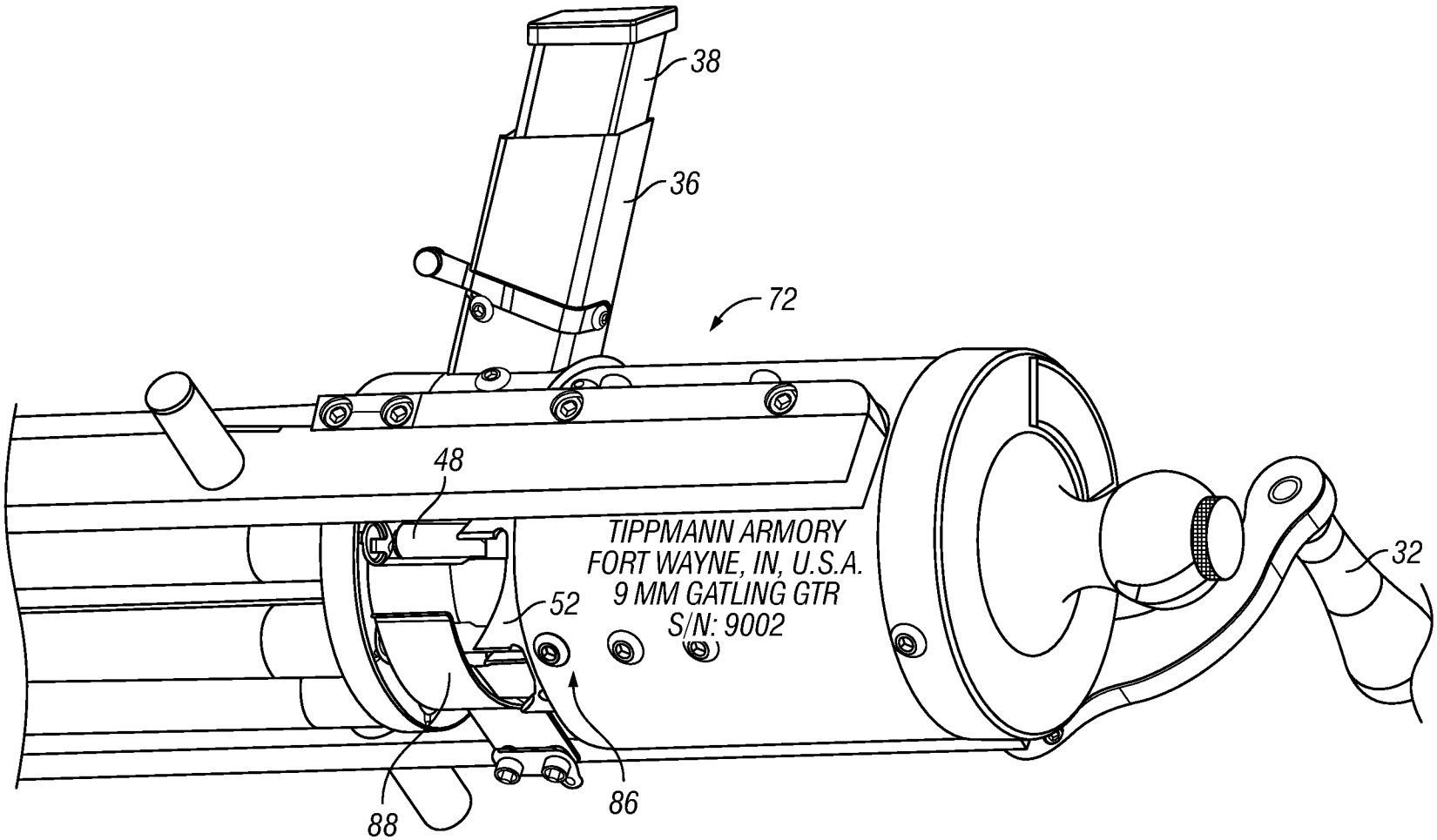
FIGS. 18-20 are a series of progressive side perspective views showing the extraction guide during firing.
Figure 19:
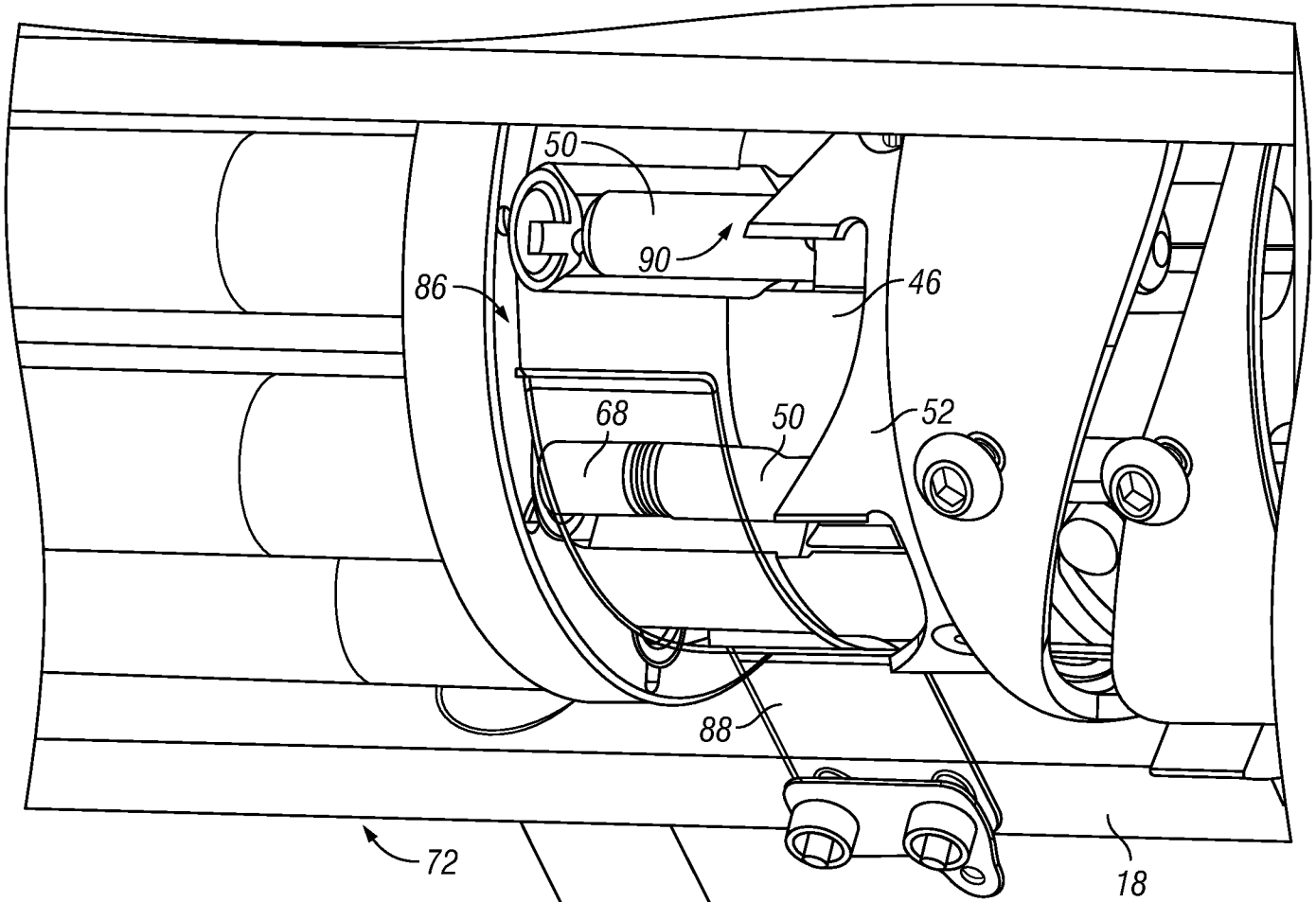
Figure 20:
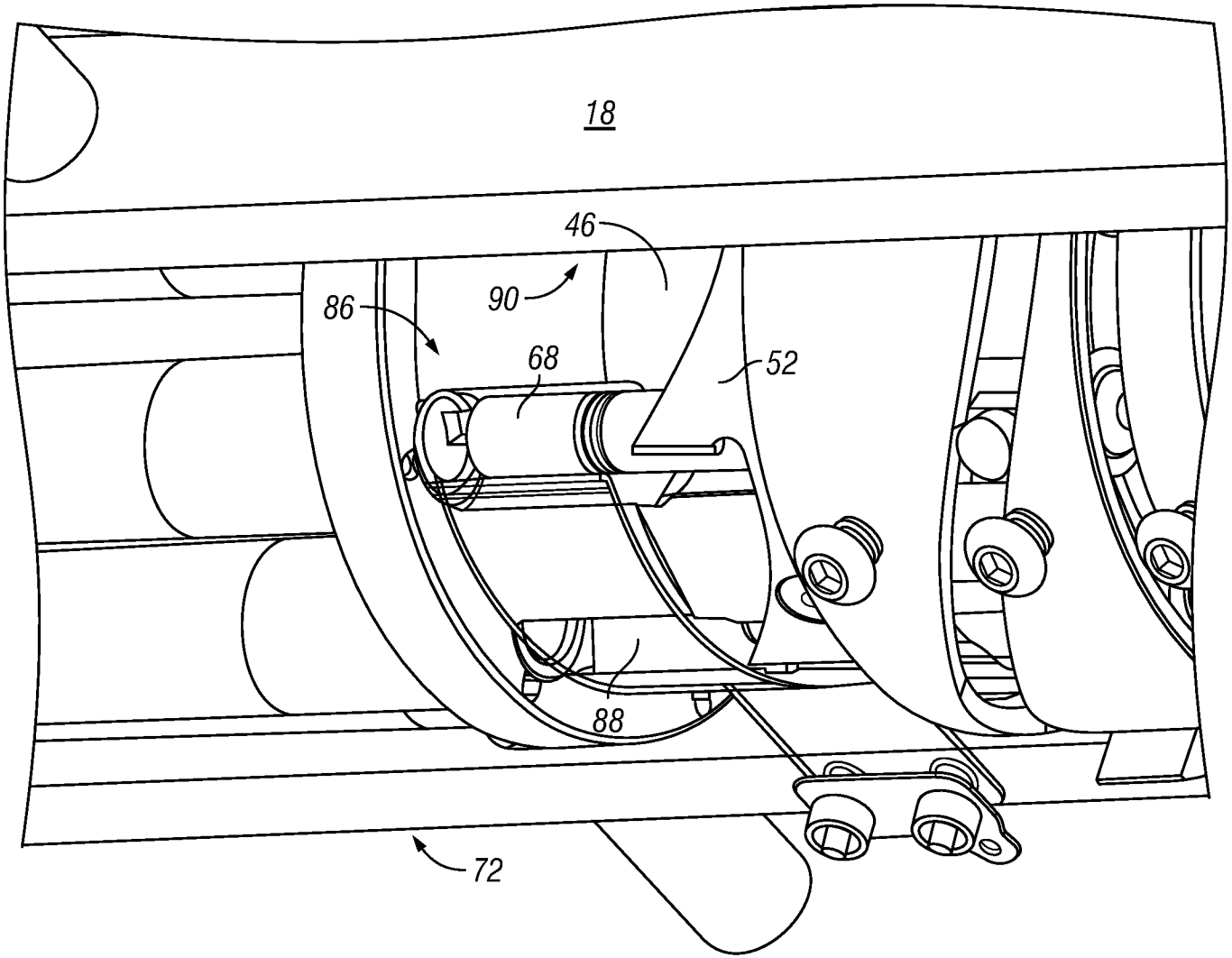

FIGS. 18-20 shows an opening 86 in the gun body 18 for the round 68 to exit the gun assembly 10. As shown, the gun assembly 10 includes an extraction guide 88 configured to engage the round 68 (casing after firing) as the bolt carrier 46 rotates in direction of arrow 72. Since this shows the chamber after firing, the bolt 50 is configured to move towards its retracted position as the bolt carrier 46 rotates. In the embodiment shown, the bolt 50 moves towards direction of arrow 90 as the bolt 50 moves towards its retracted position. As the bolt 50 moves towards its retracted position, the claw 80 of the extractor 78 pulls the casing of round 68 in direction of arrow 90. The extraction guide 88 allows the extractor 78 to remain engaged with the casing of round 68 (FIG. 19) so the extractor 78 is able to move the casing in direction of arrow 90 sufficiently to move the casing out of the barrel 34 so it can exit the gun assembly 10 (FIG. 20) via gravity.

EXAMPLES

Illustrative examples of the Gatling gun assembly disclosed herein are provided below. An embodiment of the Gatling gun assembly may include any one or more, and any combination of, the examples described below.

Example 1 is a Gatling gun with a gun body, a bolt carrier, a plurality of barrels, a plurality of bolts, a magazine feed mechanism, and a firing mechanism. The gun body defines an opening configured to receive a magazine. The rotatable bolt carrier defines a plurality of chambers. The plurality of barrels are each longitudinally aligned with a respective chamber of the plurality of chambers. The plurality of bolts are each longitudinally aligned with a respective barrel of the plurality of barrels. The magazine feed mechanism is configured to transfer a spring-loaded round from the magazine into a chamber of the plurality of chambers. The firing mechanism is configured to cause each gun bolt to fire a round in its respective chamber at a particular angular displacement during rotation of the rotatable bolt carrier.

In Example 2, the subject matter of Example 1 is further configured such that the magazine feed mechanism is configured to move the round along at least two axes.

In Example 3, the subject matter of Examples 1-2 are further configured such that the magazine feed mechanism is configured to move the round towards at least one of the plurality of barrels as the rotatable bolt carrier rotates.

In Example 4, the subject matter of Examples 1-3 is further configured such that the magazine feed mechanism comprises a ring portion and a plurality of feed portions.

In Example 5, the subject matter of Examples 1-4 are further configured such that the ring portion includes a central opening dimensioned to receive the rotatable bolt carrier.

In Example 6, the subject matter of Examples 1-5 are further configured such that the ring portion is attached to at least a portion of the rotatable bolt carrier.

In Example 7, the subject matter of Examples 1-6 are further configured such that the ring portion is configured to rotate concomitant with rotation of the bolt carrier.

In Example 8, the subject matter of Examples 1-7 are further configured such that the plurality of feed portions are approximately equally spaced around the perimeter of the magazine feed mechanism.

In Example 9, the subject matter of Examples 1-8 are further configured such that each of the plurality of feed portions correspond with a respective chamber of the plurality of chambers.

In Example 10, the subject matter of Examples 1-9 are further configured such that at least a portion of the plurality of feed portions include a cam surface to transfer the round from the magazine to a respective chamber of the plurality of chambers.

In Example 11, the subject matter of Examples 1-10 is further configured such that the cam surface comprises a curved edge of the feed portion.

In Example 12, the subject matter of Examples 1-11 are further configured such that each of the plurality of bolts include an extractor, wherein the extractor is angularly offset approximately 180 degrees with respect the magazine.

In Example 13, the subject matter of Examples 1-12 are further configured to include an extraction guide configured to support engagement of the extractor with the round as the rotatable bolt carrier rotates.

Example 14 is a Gatling gun with a gun body defining an opening configured to receive a magazine. The gun includes a rotatable bolt carrier defining a plurality of chambers. There are a plurality of barrels each longitudinally aligned with a respective chamber of the plurality of chambers. The gun has a plurality of bolts each longitudinally aligned with a respective barrel of the plurality of barrels. There is means for successively transferring spring-loaded rounds from the magazine into successive chambers of the plurality of chambers and a firing mechanism configured to cause each bolt to fire a round in its respective chamber at a particular angular displacement during the rotation of the rotatable bolt carrier.

In Example 15, the subject matter of Example 14 is further configured such that the means for transferring a spring-loaded round from the magazine into a chamber includes a plurality of cam surfaces angularly corresponding to move each round towards a respective chamber of the plurality of chambers as the rotatable bolt carrier rotates.

In Example 16, the subject matter of Example 14 is further configured such that the means for transferring a spring-loaded round from the magazine into a chamber is configured to rotate in a coaxial manner with rotation of the bolt carrier.

In Example 17, the subject matter of Example 1 is further configured such that each of the plurality of bolts include an extractor, wherein the extractor is angularly offset approximately 180 degrees with respect the magazine.

Example 18 is a method of feeding rounds into a Gatling gun. The method includes the steps of providing a gun body defining an opening configured to receive a magazine for feeding spring-loaded rounds into a plurality of chambers defined by a rotatable bolt carrier, wherein a magazine feed mechanism extends from the rotatable bolt carrier and rotates concomitant with the bolt carrier; and rotating the magazine feed mechanism to transfer spring-loaded rounds from the magazine into successive chambers of the plurality of chambers.

In Example 19, the subject matter of Example 18 is further configured such that the magazine feed mechanism includes a cam surface configured to strip the spring-loaded round from the magazine and move the spring-loaded round to a position in which the spring-loaded round can be deposited into the chamber.

In Example 19, the subject matter of Examples 18-19 are further configured such that the magazine feed mechanism includes a plurality of cam surfaces each corresponding to respective chambers of the plurality of chambers, wherein the plurality of cam surface are configured to successively transfer rounds from the magazine to successive chambers of the plurality of chambers as the magazine feed mechanism rotates.

Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. A Gatling gun comprising:

a gun body defining an opening configured to receive a magazine;

a rotatable bolt carrier defining a plurality of chambers;

a plurality of barrels each longitudinally aligned with a respective chamber of the plurality of chambers;

a plurality of bolts each longitudinally aligned with a respective barrel of the plurality of barrels;

a magazine feed mechanism configured to transfer a spring-loaded round from the magazine into a chamber of the plurality of chambers; and a firing mechanism configured to cause each gun bolt to fire a round in its respective chamber at a particular angular displacement during rotation of the rotatable bolt carrier.

2. The Gatling gun of claim 1, wherein the magazine feed mechanism is configured to move the round along at least two axes.

3. The Gatling gun of claim 1, wherein the magazine feed mechanism is configured to move the round towards at least one of the plurality of barrels as the rotatable bolt carrier rotates.

4. The Gatling gun of claim 1, wherein the magazine feed mechanism comprises a ring portion and a plurality of feed portions.

5. The Gatling gun of claim 4, wherein the ring portion includes a central opening dimensioned to receive the rotatable bolt carrier.

6. The Gatling gun of claim 5, wherein the ring portion is attached to at least a portion of the rotatable bolt carrier.

7. The Gatling gun of claim 6, wherein the ring portion is configured to rotate concomitant with rotation of the bolt carrier.

8. The Gatling gun of claim 4, wherein the plurality of feed portions are approximately equally spaced around the perimeter of the magazine feed mechanism.

9. The Gatling gun of claim 4, wherein each of the plurality of feed portions correspond with a respective chamber of the plurality of chambers.

10. The Gatling gun of claim 4, wherein at least a portion of the plurality of feed portions include a cam surface to transfer the round from the magazine to a respective chamber of the plurality of chambers.

11. The Gatling gun of claim 10, wherein the cam surface comprises a curved edge of the feed portion.

12. The Gatling gun of claim 1, wherein each of the plurality of bolts include an extractor, wherein the extractor is angularly offset approximately 180 degrees with respect the magazine.

13. The Gatling gun of claim 12, further comprising an extraction guide configured to support engagement of the extractor with the round as the rotatable bolt carrier rotates.

14. A Gatling gun comprising:

a gun body defining an opening configured to receive a magazine;

a rotatable bolt carrier defining a plurality of chambers;

a plurality of barrels each longitudinally aligned with a respective chamber of the plurality of chambers;

a plurality of bolts each longitudinally aligned with a respective barrel of the plurality of barrels;

means for successively transferring spring-loaded rounds from the magazine into successive chambers of the plurality of chambers; and a firing mechanism configured to cause each bolt to fire a round in its respective chamber at a particular angular displacement during the rotation of the rotatable bolt carrier.

15. The Gatling gun of claim 14, wherein the means for transferring a spring-loaded round from the magazine into a chamber includes a plurality of cam surfaces angularly corresponding to move each round towards a respective chamber of the plurality of chambers as the rotatable bolt carrier rotates.

16. The Gatling gun of claim 14, wherein the means for transferring a spring-loaded round from the magazine into a chamber is configured to rotate in a coaxial manner with rotation of the bolt carrier.

17. The Gatling gun of claim 14, wherein each of the plurality of bolts include an extractor, wherein the extractor is angularly offset approximately 180 degrees with respect the magazine.

18. A method of feeding rounds into a Gatling gun, the method comprising:

providing a gun body defining an opening configured to receive a magazine for feeding spring-loaded rounds into a plurality of chambers defined by a rotatable bolt carrier, wherein a magazine feed mechanism extends from the rotatable bolt carrier and rotates concomitant with the bolt carrier; and rotating the magazine feed mechanism to transfer spring-loaded rounds from the magazine into successive chambers of the plurality of chambers.

19. The method of claim 18, wherein the magazine feed mechanism includes a cam surface configured to strip the spring-loaded round from the magazine and move the spring-loaded round to a position in which the spring-loaded round can be deposited into the chamber.

20. The method of claim 19, wherein the magazine feed mechanism includes a plurality of cam surfaces each corresponding to respective chambers of the plurality of chambers, wherein the plurality of cam surface are configured to successively transfer rounds from the magazine to successive chambers of the plurality of chambers as the magazine feed mechanism rotates.

* * * * *